US005345627A

United States Patent [19]

Cammarata

[11] Patent Number: 5,345,627

[45] Date of Patent: Sep. 13, 1994

[54] TOWEL WITH RELEASABLY ATTACHED PILLOW

[76] Inventor: Mary P. Cammarata, 1104 Main St., Belmar, N.J. 07719

[21] Appl. No.: 151,963

[22] Filed: Nov. 15, 1993

[51] Int. Cl.[5] ..... A47G 9/06; A47G 9/00

[52] U.S. Cl. ..... 5/419; 5/417; 5/922; 5/636

[58] Field of Search ..... 5/417–420, 5/922, 923, 636, 482

[56] References Cited

U.S. PATENT DOCUMENTS

| | | | |
|---|---|---|---|
| D. 280,169 | 8/1985 | Henry | D6/603 |
| 2,045,784 | 6/1936 | Leve | 5/419 |
| 3,082,437 | 3/1963 | Upthagrove | 5/419 |
| 3,828,377 | 8/1974 | Eary, Sr. | 5/465 |
| 4,382,306 | 5/1983 | Lickert | 5/465 |
| 4,723,329 | 2/1988 | Vaccaro | 5/455 |
| 4,924,543 | 5/1990 | Moss et al. | 5/484 |
| 5,163,192 | 11/1992 | Watson | 5/419 |

*Primary Examiner*—Alexander Grosz

*Attorney, Agent, or Firm*—Charles I. Brodsky

[57] ABSTRACT

A beach pillow including a foam—e.g. a polyester—within a case enclosure covered by a terrycloth material so as to be machine-washable and dryable. In a preferred embodiment of the invention, a bottom-side of the case is provided with a releasable hook-and-loop type adhesive backing to adhere with a comparable adhesive material at a facing side of a towel, to allow for the holding of the pillow to the towel in a substantially vertical position when the towel is draped over a chair. A fastener at a corner extremity of the case permits the pillow to be easily carried about, and its temporary securement to a fixed object to be held thereby under varying wind conditions.

7 Claims, 2 Drawing Sheets

TOWEL WITH RELEASABLY ATTACHED PILLOW

FIELD OF THE INVENTION

This invention relates to pillows and towels, and, more particularly, to pillows and towels which are especially suited for beach-use. (In this context, and as will be appreciated from the description below, the term "beach-use" is intended to cover usage at the ocean, lake, pool, park, etc., and wherever someone may go just to lie-down and soak up the sun's rays.)

BACKGROUND OF THE INVENTION

As is well known and understood, people lying on blankets to absorb the sun's rays often find that position quite uncomfortable. Typically, towels are rolled to prop up one's head; or books, duffel bags, radios, canteens, shoes and other clothing, for example, are placed in an attempt to align the face to best absorb the sun's radiations. As will be appreciated by anyone who has tried these methods, there is a lot to be desired in the manner of increasing comfort to one being in this position. Unfortunately, there does not appear to be anything available to ease this problem.

SUMMARY OF THE INVENTION

As will become clear hereinafter, the present invention provides a beach pillow which includes a foam within a case enclosure covered by a terrycloth material so as to be machine-washable and dryable, and which overcomes these problems. As will be seen, the beach pillow is of a size substantially 12" wide by 16" long, and with a filling of polyester foam in a preferred embodiment, to a thickness of substantially 5". In such preferred embodiment, to be described hereinafter, a bottom-side of the case enclosure is provided with a releasably hook-and-loop type adhesive backing to adhere with a comparable adhesive material at a facing side of a towel, to allow for the holding of the pillow to the towel in a substantially vertical position, in permitting the pillow to continue to be used in those instances where the towel is draped over a chair. A fastener is included at a corner extremity of the case—as will be seen—to permit the pillow to be easily carried about and its temporary securement to a fixed object—such as the chair—to be held thereby under varying wind conditions. As will be further described, a towel according to the invention further includes a user-adjustable flap to expose and/or cover its releasably adhesive securing material, with the flap being composed of the same material and presenting the same appearance as the remainder of the towel, so as to be non-differentiable from the towel when the pillow is not temporarily secured therewith.

As will be appreciated by those skilled in the art, the beach pillow—together with its accompanying towel—provides the user with an arrangement to allow him or her to benefit from the tanning of the sun's radiations, and more specifically, in a comfortable position.

BRIEF DESCRIPTION OF THE DRAWING

These and other features of the present invention will be more clearly understood from a consideration of the following description, taken in connection with the accompanying drawings, in which.

DETAILED DESCRIPTION OF THE DRAWING

Figure 1:
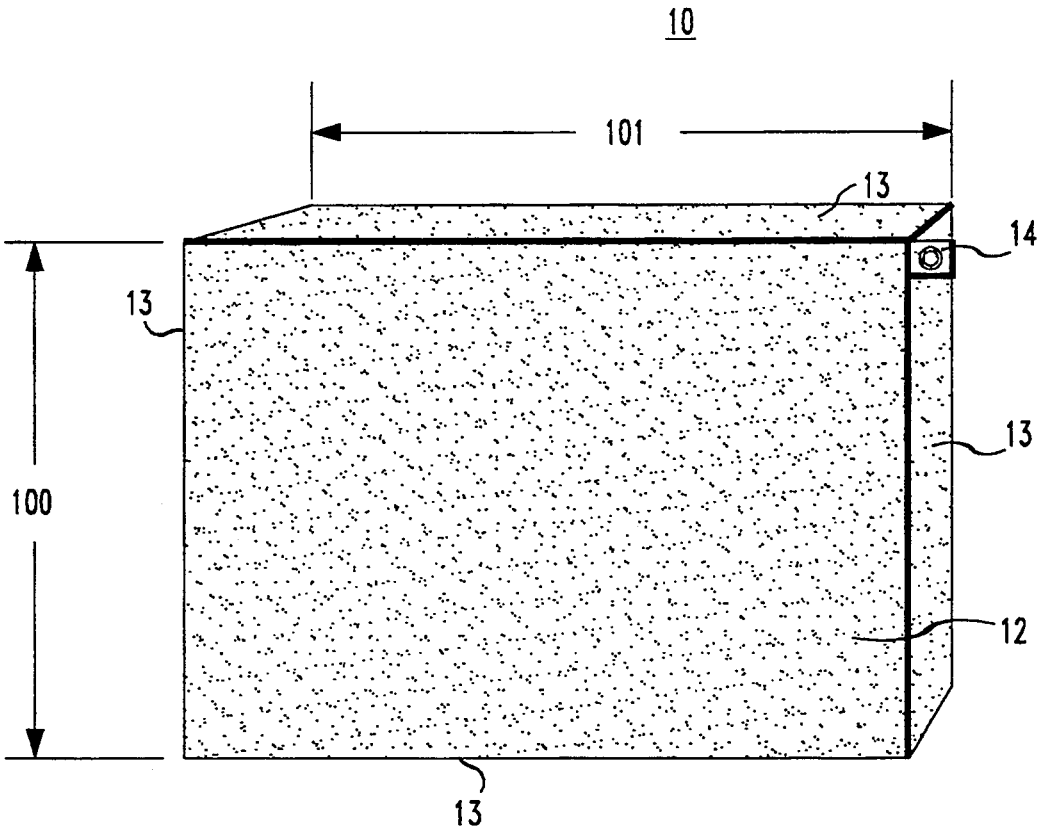
FIG. 1 schematically shows a machine-washable and dryable beach pillow according to the invention.
Figure 2:
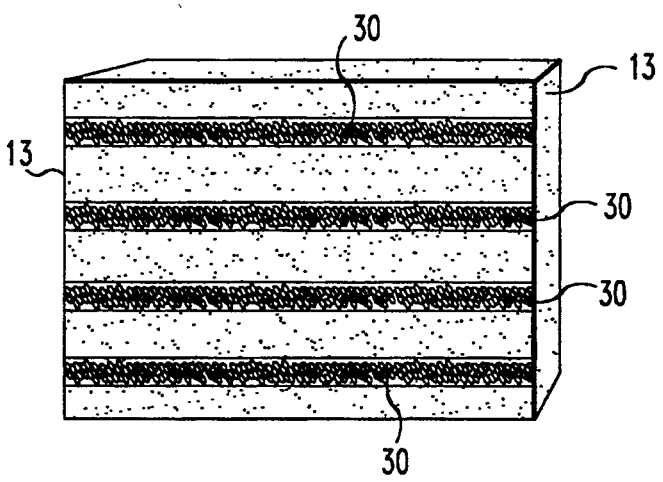
FIG. 2 shows the bottom side of the pillow with its releasably adhesive securement when used to couple with a beach towel.
Figure 3:
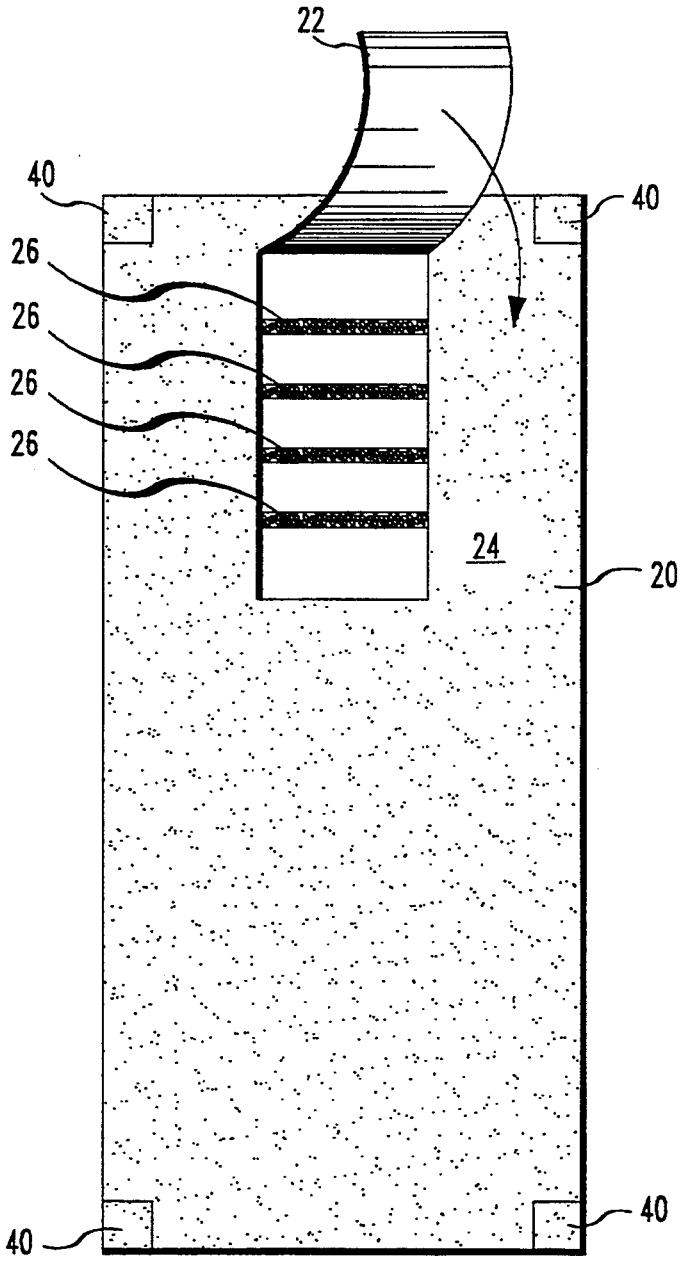
FIG. 3 illustrates a towel according to the invention, for use with the beach pillow of FIGS. 1 and 2.

In FIGS. 1–3, the beach pillow 10 will be understood to include a case enclosure 12 sealed at its sides 13 and filled with a foam—e.g. polyester, and completely covered with a terrycloth material. As will be appreciated by those skilled in the art, the pillow 10 thus is one which is machine-washable and dryable, and when selected of dimensions 100, 101 of substantially 12" and 16" respectively, is readily susceptible for beach-use, especially with the polyester foam filling the enclosure 10 to a thickness of substantially 5". In accordance with a preferred embodiment of the invention, means are detachably coupled to an edge surface of the case enclosure—as at 14—to assist in grasping the enclosure 12 to be carried about, and for securing the enclosure 12 to a fixed object, such as a chair (not shown), when not in use. Any appropriate fastener may be employed for this purpose, coupled to the enclosure 12, as by an eyelet located at 14, and of any appropriate type configuration and manner of attachment. Testing of a beach pillow of the type described has proved it to be quite comfortable in use—just laid down on the ground or on a blanket for example—and especially suited for beach use where it can be easily carried about and employed as a much improved alternative to other manners of propping up one's head through rolled up clothing, towels, or just with whatever may be available in an attempt to orient one's face toward the sun's rays.

FIGS. 2 and 3 illustrate additional configurations of the beach pillow of FIG. 1 for use with a towel 20 which may simply be laid on the ground or draped over a chair. More specifically, the towel 20—selected of any material, color or appearance—is shown as including a user-adjustable flap 22 which can be raised or lowered to expose and/or cover respectively any appropriate type of securing means 24, illustratively shown as four sections of releasably hook-and-loop type adhesive backings 26. Thus, with the flap 22 raised as shown, the backing strips 26 are in position ready for securement, but with the understanding that when the flap 22 is lowered to cover the strips 26, the same appearance is presented as the rest of the towel in view of the fact that the flap is composed of the same material, coloration and any patterning as the rest of the towelling.

FIG. 2, on the other hand, shows the bottom-side of the enclosure 12 of FIG. 1, showing the four strips of preferably the same releasably hook-and-loop type adhesive backing materials 30 vertically disposed with one another the same distance as between the strips 26 of FIG. 3. Whether the length from left-to-right of the releasably adhesive backing strips 30 are the same as, greater than, or less than, the left-to-right side lengths of the backing strips 26 of FIG. 3, it will be appreciated that by placement of the pillow 10 onto the towel 20, a temporary securement of the pillow 10 to the towel 20 results. As will be appreciated, such arrangement holds the pillow 10 to the towel 20 in varying wind conditions. To keep the towel 20 from blowing away when laid on the ground in instances of wind gusts, the towel 20 may be weighted in any appropriate manner at predetermined positions along its extremity, such as at the corners 40. Testing has additionally shown that by placing a pillow 10 of the type described onto the towel 20 in this manner comfortably props the user's head to comfortably receive the tanning rays of the sun, when the towel 20 is generally laid flat on the ground.

However, because of the degrees of securement afforded by the releasably adhesive strips 26 and 30, the pillow 10-towel 20 combination equally serves in comfortably aligning the body when the two are draped over a chair, with the pillow 10 then being retained essentially in a vertical position. In this manner, and depending upon the exact position on the towel 20 where it is folded onto the chair, the pillow 10 could be retained in position anywhere at the cervical, thoracic or lumbar spine areas of the user, according to preference. Again, once the pillow is detached from such position, the flap 22 could be lowered to cover the adhesive backing strips 26, and give the general appearance of the towel in that location as well.

While there have been described what are considered to be preferred embodiments of the present invention, it will be readily appreciated by those skilled in the art that modifications can be made without departing from the scope of the teachings herein. For example, it will be apparent that a type of pocket-enclosure may be provided at an underside of the towel 20 to loop-around and secure it to a chair if desired and that pillow configurations other than the rectangular arrangement disclosed may be employed. Such modifications will be understood as fitting within the teachings of the invention described, just as there can be modifications of the foam composition serving to fill the terrycloth covered case enclosure of the invention, as long as such foam compositions continue to allow the beach pillow to be both machine washable and dryable. For at least such reasons, therefore, resort should be had to the claims appended hereto for a true understanding of the scope of the invention.

I claim:

1. A towel and pillow combination, adapted to support a human user, comprising a towel having a first releasably adhesive securing means proximate one end thereof, a user adjustable flap, substantially smaller in size than said towel, to expose and/or cover said releasably adhesive securing means, and a pillow having a second releasably adhesive securing means adapted to releasably fasten the pillow to the first releasably adhesive securing means on the towel, when said first releasably adhesive securing means is left exposed by said user-adjustable flap.

2. The combination of claim 1 wherein said pillow is of rectangular configuration substantially 12″ wide by 16″ long.

3. The combination of claim 1 also including means detachably coupled to an edge surface of said pillow, for grasping in carrying said pillow and for securing said pillow to a fixed object.

4. The combination of claim 1 wherein said flap is composed of the same material and presents the same appearance as the remainder of said towel.

5. The combination of claim 1 wherein there is also included means for weighing-down said towel predetermined extremity positions thereof.

6. The combination of claim 5 wherein said pillow is covered with a terrycloth material and encloses a polyester foam.

7. The combination of claim 6 wherein said polyester foam fills said pillow to a thickness of substantially 5″.

* * * * *